United States Patent [19]

Deutsch

[11] Patent Number: 4,732,071

[45] Date of Patent: Mar. 22, 1988

[54] TUNING INDICATOR FOR MUSICAL INSTRUMENTS

[75] Inventor: Ralph Deutsch, Sherman Oaks, Calif.

[73] Assignee: Kawai Musical Instrument Mfg. Co., Ltd, Hamamatsu, Japan

[21] Appl. No.: 14,758

[22] Filed: Feb. 13, 1987

[51] Int. Cl.[4] ..... G10G 7/02

[52] U.S. Cl. ..... 84/454; 84/DIG. 18

[58] Field of Search ..... 84/454, DIG. 18; 324/79 D, 79 R

[56] References Cited

U.S. PATENT DOCUMENTS

| | | | |
|---|---|---|---|
| 4,122,751 | 10/1978 | Calvin | 84/DIG. 18 |
| 4,271,746 | 6/1981 | Dobbie | 84/454 |
| 4,313,361 | 2/1982 | Deutsch | 84/DIG. 18 |
| 4,399,732 | 8/1983 | Rothschild et al. | 84/DIG. 18 |

*Primary Examiner*—L. T. Hix
*Assistant Examiner*—David Porterfield
*Attorney, Agent, or Firm*—Ralph Deutsch

[57] ABSTRACT

A tuning indicator is disclosed in which the octave, note within the octave, and a tuning error is displayed for a musical tone played into a microphone. A bank of digital octave filters, a bank of digital note filters, a bank of digital cent filters operate simultaneously and in parallel to analyze the fundamental frequency of the musical tone. The filters operate by computing the autocorrelation function of the input signal and then performing a Fourier transform to obtain the frequency analysis data. An efficient and simple implementation is disclosed for the computations including the analog-to-digital signal conversion, the computation of the autocorrelation function, and the Fourier transform.

13 Claims, 8 Drawing Figures

TUNING INDICATOR FOR MUSICAL INSTRUMENTS

BACKGROUND OF THE INVENTION

1. Field of the Invention

This invention relates to the measurement of the fundamental frequency of a musical tone and in particular is concerned with a system for indicating the deviation of a musical tone from a prespecified frequency.

2. Description of the Prior Art

Musicians are almost daily faced with the task of tuning their instruments to some prespecified frequency. The usual standard frequency is $A_4=440$ Hz. This tuning procedure can be tedious and represents a challenge for many musicians depending upon their current maturity.

A possible approach to the tuning procedure would be to use a microphone coupled to a frequency measuring instrument. Such an approach can be somewhat slow and the equipment might be expensive. Usually the musician does not really want a true measure of a musical tone's frequency. Instead he wishes an indication of whether or not a note played on his instrument is flat or short with respect to a prespecified standard pitch, or frequency, as well as some simple measure of how much the instrument's tone differs from the standard pitch.

The musician generally knows the octave and the note within the octave for the played note. This information can be used to set controls on the tuning device. Tuning devices using preset switches have been manufactured. However it is convenient, especially when a group of musicians wish to share a common tuning indicator, to have a tuning device which does not require switches to be selected to correspond to a priori knowledge of an octave and the note within the octave.

It is an object of the present invention to provide an indication of the offset of a musical tone from a prespecified standard frequency without using a priori knowledge of the octave or musical note within the octave.

A tuning indicator is essentially a calibrated spectrum analyzer having analysis filters corresponding to the frequencies of the musical scale. It is a further object of the present invention to perform a calibrated spectral analysis of a musical tone using a system of digital logic which can be implemented using conventional state-of-the-art microelectronic devices.

SUMMARY OF THE INVENTION

A tuning indicator for acoustic musical instruments is described in which a parallel bank of actave filters, note filters, and cent filters are employed to determine the octave, note and frequency error of a musical tone played into a microphone. Each bank of filters is implemented to provide simultaneous frequency analysis of a prespecified range of frequencies. The output octave determination from the bank of octave filters is used to set the frequency range of the note filters. The output note determination from the bank of note filters is used to set the frequency range of the cent filters. The output cent determination of the cent filter indicates the frequency error of the musical tone.

Each bank of filters operates by first computing the autocorrelation function of the musical tone and then using a Fourier transfer to find the spectral content of the musical tone. A random number generator and a comparator are used in combination to convert an analog signal generated by a microphone into a sequence of one-zero signals. A shift register and an exclusive OR-gate are used in combination to generate the components of the musical tones autocorrelation function. A bank of contiguous filters is implemented by using a combination of a sinusoid table storing preselected trigonometric function values, a 2's complement device, and an adder-accumulator for each filter element in the bank of contiguous filters.

A maximum select circuit logic is used to identify the filter that has the maximum response to the input musical tone.

The output data from the maximum select circuit logic for the octave filters, note filters, and cent filters is displayed on an indicator which provides a visual display of the tuning and error in tuning of a musical tone.

BRIEF DESCRIPTION OF THE DRAWINGS

The detailed description of the invention is made with reference to the accompanying drawings.

FIG. 3 is a schematic diagram of the maximum octave detect 13.

DETAILED DESCRIPTION OF THE INVENTION

The present invention is directed toward a system for indicating the tuning state of a musical instrument.

Figure 1:
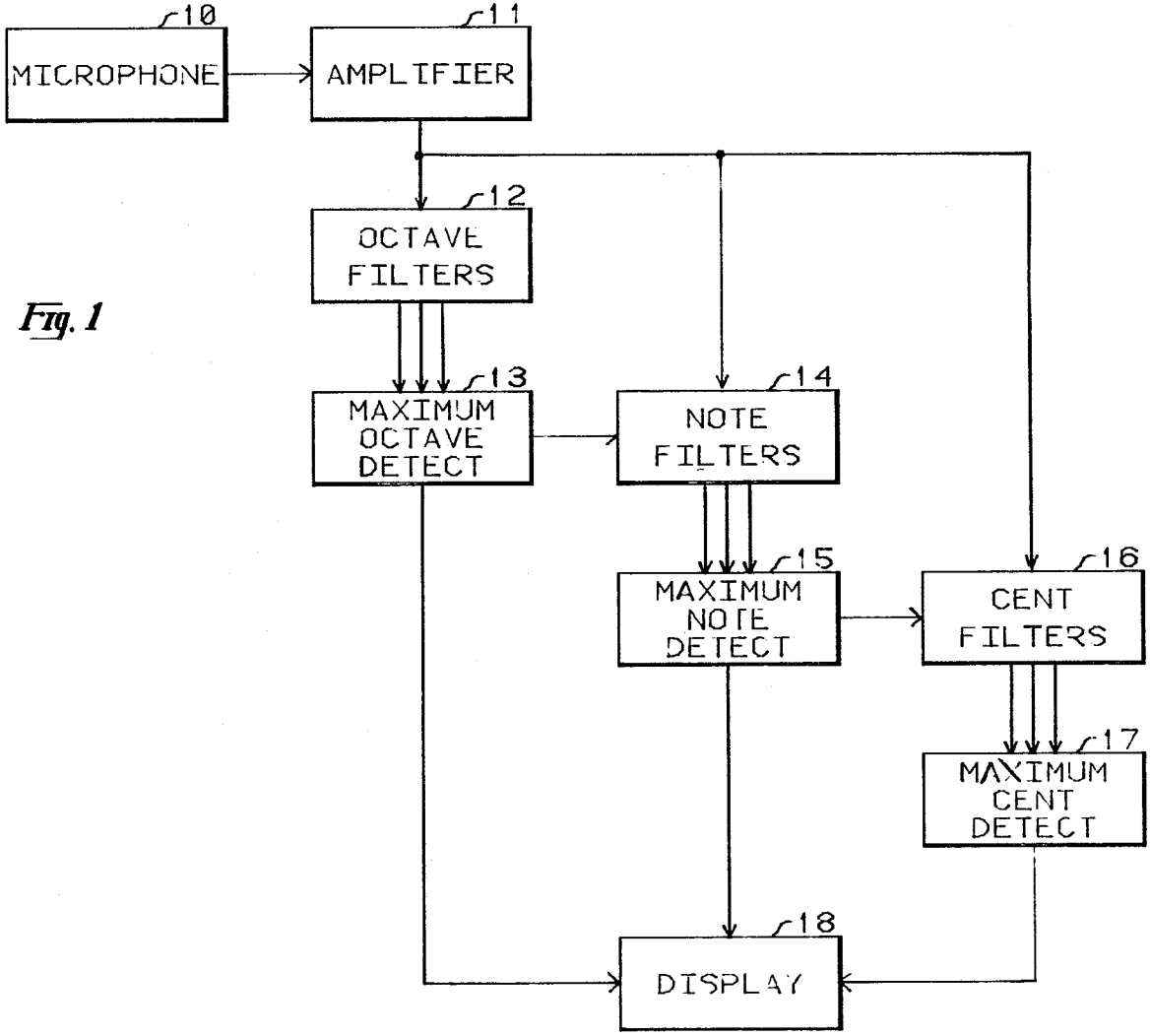
FIG. 1 is a schematic diagram of an embodiment of the invention.

FIG. 1 illustrates an embodiment of the present invention. The microphone 10 is used to convert the audible sound produced by a musical instrument into an electrical analog signal. The amplifier 11 is a conventional amplifier which transforms the signal produced by the microphone 10 into a signal level which is suitable to be used by the remaining system elements.

The invention is not limited to musical instruments and will function with any sound source having a fundamental frequency within the frequency range of the tuning system. If an electronic musical instrument is to be tuned, the microphone 10 can be by-passed and the electrical analog output signal from the electronic musical tone generator can be connected directly to the amplifier 11.

The octave filters 12 comprise a bank of contiguous frequency band filters which span the full desired frequency range of the tuning indicator in a number of octaves. For example, if the tuning instrument is intended for use with instruments having a tuning range of $C_2$ to $C_7$ then there would be six octave filters. The maximum octave detect 13 determines the musical octave for the tone played into the microphone 10.

The octave data output produced by the maximum octave detect 13 is used to set the octave range for the set of contiguous frequency filters comprising the note filters 14. The contiguous filters in the note filters 14 span a single preselected musical octave and are spaced in frequency by separations corresponding to the frequencies within an octave of musical notes for an equal tempered scale. The maximum note detect 15 determines which note within an octave has been played into the microphone 10.

The note output data from the maximum note detect 15 is used to set the note range for the set of contiguous frequency filters comprising the cent filters 16. The cent filters 16 span a range of 7 cents on either side of the frequency of the note selected by the maximum note detect 15. The maximum cent detect 17 determines the difference in frequency of the tone detected by the microphone 10 from the true musical frequency as measured in cents.

The output data from the maximum octave detect 13, the maximum note detect 15, and the maximum cent detect 17 is furnished to the display 18. The display 18 displays the octave, note, and cent error of the tone detected by the microphone 10.

Figure 2:
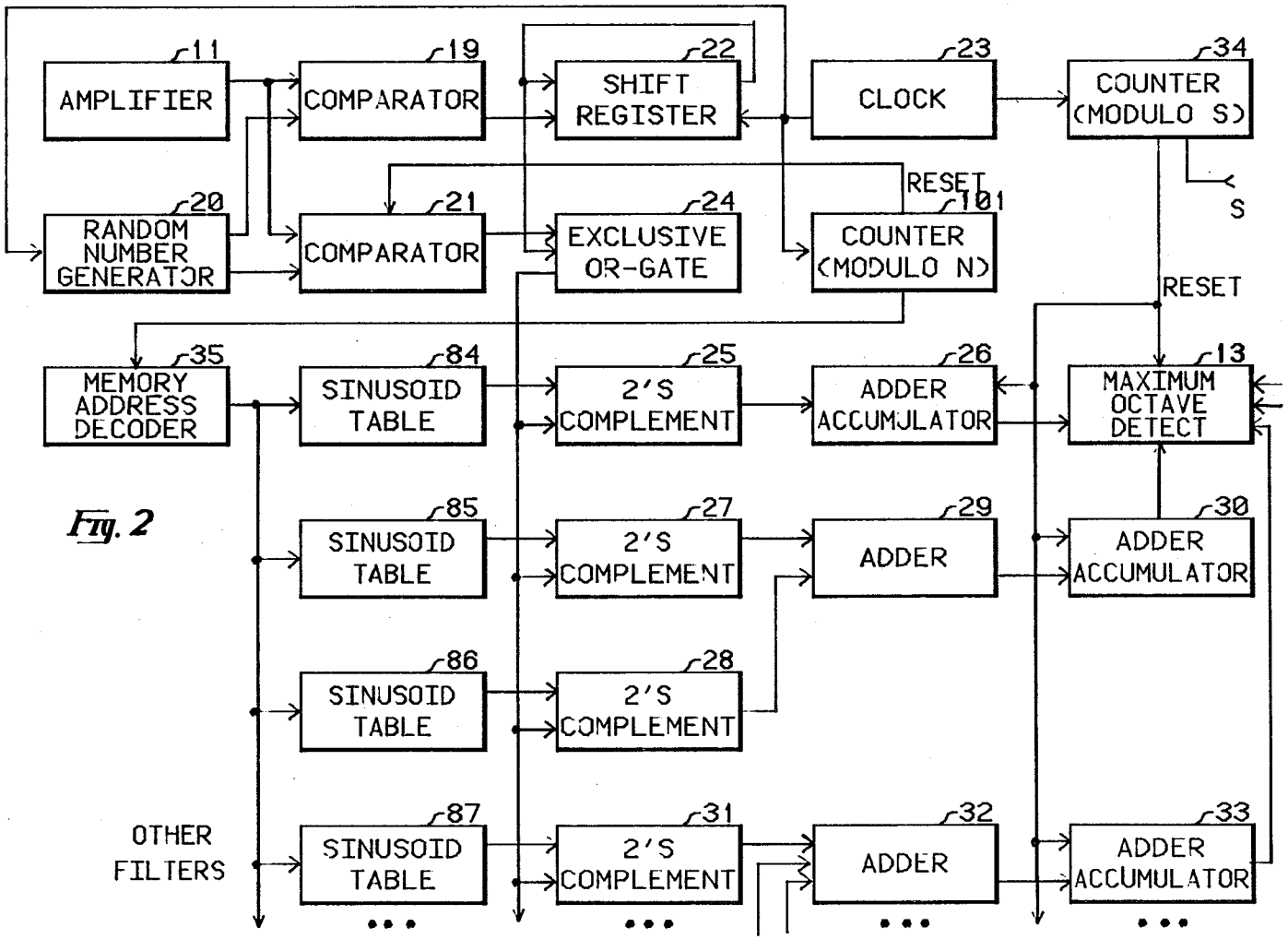
FIG. 2 is a schematic diagram of the octave filters 12.

The detailed logic of the octave filters 12 is shown in FIG. 2. The octave filters 12 function by first computing the autocorrelation function of the signal produced by the microphone 10. The autocorrelation function is then converted to a power spectral density function by means of a subsystem which implements a discrete Fourier transform algorithm.

The random number generator 20 generates pairs of random numbers $y_i$ and $y_j$ which are each statistically independent and are uniformly distributed in value and have a maximum amplitude equal to a number B and a minimum amplitude equal to $-B$. There are many implementations for suitable random number generators. One such implementation is disclosed in U.S. Pat. No. 4,327,419 entitled "Digital Noise Generator For Electronic Musical Instruments." This patent is hereby incorporated by reference.

The clock 23 is designed to generate timing signals at a frequency which is about 2.1 times the maximum frequency range of the tuning indicator. If the maximum fundamental frequency is $C_7$, then the clock 23 operates at a frequency of $2.1 \times 2093 = 4395.3$ Hz.

The comparator 19 generates a logic "1" state binary signal if the signal $x_i$ furnished by the amplifier 11 at a time $t_i$, corresponding to a timing signal furnished by the clock 23, is greater than or equal in numeric magnitude to the random number $y_i$ generated by the random number generator 20 at the same time $t_i$. If the data value $x_i$ is less in numeric amplitude than the random number $y_i$ then a logic "0" state binary signal is generated by the comparator 19. The sequence of binary state signals generated by the comparator 19 are stored in the shift register 22. The shift register 22 can store N data points and is operated in a conventional end-around mode in response to the timing signals furnished by the clock 23. That is, the shift register operates by taking an output data point and reinserting it in the input position of the serial sequence storage of the N data points generated by the comparator 19.

The action of the comparator 19 is to convert the analog signal from the amplifier 11 to a digital signal and to compute the value of sgn $z_i$, for the difference of the signals $x_i - y_i$. Sng denotes the mathematical signum function and the subscript i denotes a quantity occurring at a time $t_i$ corresponding to one of the timing signals produced by the clock 23. For each data value generated by the comparator 19, the shift register 22 is shifted N times after the new value has been placed in the initial, or input, shift register position thereby replacing the oldest previously stored data value in the shift register 22.

In the same fashion as described for the comparator 19, the comparator 21 will generate a logic "1" binary state signal if the signal amplitude $z_j$ from the amplifier 11 is greater than or equal to the second random number $y_j$ created by the random number generator 19. The comparator 21 will generate a logic "0" binary state signal if the signal amplitude $x_j$ is less than the random signal $y_j$. The action of the comparator 21 is to furnish the value of the quantity sgn $z_j$=sgn $(x_j - y_j)$.

The autocorrelation function R(q) for the sequence of signal values $x_i$; i=1, 2, . . . is defined by the relation $$R_x(q) = E\{x_i x_{i-q}\} \qquad \text{Eq. 1}$$

where q is the time lapse between a pair of data points $x_i$ and $x_{i-q}$ measured in the number of data points q. E{ } denotes the expected, or the statistical weighted average, of the quantity contained within the braces. Eq. 1 can be written in the following equivalent form $$R(q) = [1/(N-q)] \sum_{i=1}^{N-q} x_i x_{i-q} \qquad \text{Eq 2}$$

where N denotes the number of pairs of data values used to form the average value.

For the system shown in FIG. 2, the autocorrelation function in the form of Eq. 2 can be written as $$R_x(q) = [B^2/(N-q)] \sum_{i=1}^{N-q} \text{sgn } z_i \text{ sgn } z_{i-q} \qquad \text{Eq. 3}$$

The product of the signum functions in Eq. 3 obey the following truth table.

TABLE 1

| sgn $z_i$ | sgn $z_{i-q}$ | sgn $z_i$ * sgn $z_{i-q}$ |
|---|---|---|
| 1 | 1 | 1 |
| 0 | 0 | 1 |
| 1 | 0 | 0 |
| 0 | 1 | 0 |

The logic truth table 1 is the same as the truth table for a conventional XOR-gate.

The comparator 21 generates a signum value each time that the counter 101 is reset to its initial count state. Counter 101 is incremented by the timing signals produced by the clock 23 and is implemented to count modulo N.

The exclusive OR-gate 24, according to the logic shown in Table 1, forms the product of the previous N signum values generated by the comparator 19 with the current signum value generated by the comparator 21.

The power spectral density function G(f) is defined as the Fourier transform of the autocorrelation function R(q). Thus G(f) can be written in the form $$G(f) = 2T_s \left[ R_x(O) + 2 \sum_{q=1}^{m-1} R(q)\cos(qf/f_s) + R(m)\cos(\pi m f/f_s) \right]. \qquad \text{Eq. 4}$$

where $$m = 2f_s/D \qquad \text{Eq. 5}$$

and $$T_s = 1/f_s \qquad \text{Eq. 6}$$

D is the resolution bandwidth of one of the contiguous filters.

In the system shown in FIG. 2, the power spectral density G(f) is only computed at discrete frequencies $f = kf_n/m$, Eq. 4 can be written in the discrete form as follows $$G_k = G(kf_s/m) = \qquad \text{Eq. 7}$$

$$2T_s\left[R(O) + 2\sum_{q=1}^{m-1} R(q)\cos(\pi gk/m) + (-1)^k R(m)\right]$$

If Eq. 3 and Eq. 7 are combined the result is $$C_k = 2T_sB^2/(N-q)\left[\sum_{i=1}^{N-q} h_i(O)\,(-1)^k \sum_{i=1}^{N-q} h_i(m) + 2\sum_{q=1}^{m-1}\sum_{i=1}^{N-q} h_i(q)\cos(\pi qk/m)\right] \qquad \text{Eq. 8}$$

where $$h_i(q) = \text{sgn } z_i \text{ sgn } z_{i-q} \qquad \text{Eq. 9}$$

The first two terms on the right hand side of Eq. 8 are independent of frequency and thus their contribution can be neglected in a frequency determination calculation. It is noted in the last summation in Eq. 8 that $h_i(q)$ either has the value "1" or the value "0". The "0" value is considered as a negative sign in definition of the signum function. Therefore the indicated multiplication in the last summation can be simply implemented as a 2's complement binary operation on a binary data word for the trigonometric cosine function in which no complement is performed if $h_i(q)=1$ and in which a 2's complement operation is performed if $h_i(q)=0$.

If for illustrative purposes the tuning indicator is designed to cover the octaves $C_2$ to $C_7$, the maximum resolution, (minimum frequency bandwidth) is $$D = f_{C3} - f_{C2} = 110.82 - 65.41 \text{ Hz} \qquad \text{Eq. 10}$$

Because of the logarithmic range of musical frequencies, one filter ha in the an width D can be used to cover the octave range $C_3$ to $C_4$, two such D bandwidth filters can cover the next octave range of $C_4$ to $C_5$, four such D bandwidth filters can cover the next octave range of $C_5$ to $C_6$, and so on.

The exclusive OR-gate 24 performs the calculation of $h_i(q)$ shown in Eq. 9. The sinusoid table 84 stores values of the trigonometric cosine function cos ($\pi q/m$); q=0, 2, . . . , N for the values of m defined by Eq. 5. For the illustrative system with $f_s$=2093 Hz, $$m = 2f_s/D = 2\times 2093/65.41 = 64 \qquad \text{Eq. 11}$$

The output numerical value from the 2's complement 25 is added to the content of an accumulator which is contained in the adder-accumulator 26.

The sinusoid table 85 stores values of the trigonometric cosine function cos ($\pi q2/m$) and the sinusoid table 86 stores values of the trigonometric function cos ($\pi q3/m$). The adder 29 sums the data values transferred by the 2's complement 27 and the 2's complement 27. The summed value produced by the adder 29 is added to the content of an accumulator which is contained in the adder-accumulator 30.

TABLE 2

| Octave | Frequency Range | No. of Filters | Sinusoid Table and Values |
|---|---|---|---|
| 2 | $C_2$–$B_2$ | 1 | 84: cos($\pi q/m$) |
| 3 | $C_3$–$B_3$ | 2 | 85: cos($\pi q2/m$) |
| | | | 86: cos($\pi q3/m$) |
| 4 | $C_4$–$B_4$ | 4 | 87: cos($\pi q4/m$) |
| | | | 88: cos($\pi q5/m$) |
| | | | 89: cos($\pi q6/m$) |
| | | | 90: cos($\pi q7/m$) |
| 5 | $C_5$–$B_5$ | 8 | 91: cos($\pi q8/m$) |
| | | | 92: cos($\pi q9/m$) |
| | | | 93: cos($\pi q10/m$) |
| | | | 94: cos($\pi q11/m$) |
| | | | 95: cos($\pi q12/m$) |
| | | | 96: cos($\pi q13/m$) |
| | | | 97: cos($\pi q14/m$) |
| | | | 98: cos($\pi q15/m$) |
| 6 | $C_6$–$B_6$ | 8 | 99: cos($\pi q16/m$) |
| | | | 100: cos($\pi q17/m$) |
| | | | 101: cos($\pi q18/m$) |
| | | | 102: cos($\pi q19/m$) |
| | | | 103: cos($\pi q20/m$) |
| | | | 104: cos($\pi q21/m$) |
| | | | 105: cos($\pi q22/m$) |
| | | | 106: cos($\pi q23/m$) |
| | | | 107: cos($\pi q24/m$) |
| | | | 108: cos($\pi q25/m$) |
| | | | 109: cos($\pi q26/m$) |
| | | | 110: cos($\pi q27/m$) |
| | | | 111: cos($\pi q28/m$) |
| | | | 112: cos($\pi q29/m$) |
| | | | 113: cos($\pi q30/m$) |
| | | | 114: cos($\pi q31/m$) |
| 7 | $C_7$–$C_7$ | 1 | 115: cos($\pi q32/m$) |

To simplify the drawing of FIG. 2, not all the system elements are shown explicitly in the figure. Table 2 lists all the sinusoid tables 84 through 115 although only the sinusoid tables 84–87 are shown explicitly in FIG. 3. Table 2 lists the number of filters for each of the octaves as well as the trigonometric cosine values that are stored in each of the sinusoid tables. For example there are 4 filters for octave 4. This octave band is covered by means of the sinusoid tables 87 through 90 which store the trigonometric cosine values shown in the last column of Table 2. Each of the sinusoid tables transfers its output data to an associated 2's complement in the manner shown explicitly in FIG. 2 for the first two octaves. The output from each of the 2's complement units for a given octave are summed by means of an adder and the summed values is added to the content of an accumulator contained in an adder-accumulator which is associated with each octave.

The memory address decoder 35 simultaneously reads out stored trigometric function values from the set of sinusoid tables in response to the count state of the counter 101. The count state of the counter 101 provides the value of the parameter m.

The contents of the accumulators in each of the adder-accumulators associated with an octave filter are furnished to the maximum octave detect 13. The adder-accumulators are shown symbolically in FIG. 3 as the set of blocks 31,33.

The maximum octave detect 13 determines which one of the six accumulators contained in the six adder-accumulators has the maximum numerical values at the time counter 35 generates a RESET signal.

The counter 34 counts the timing signals produced by the clock 23 modulo a prespecified modulo number S. Each time that counter 34 is incremented so that it returns to its minimal count state, a RESET signal is generated. The modulo number S is provided to counter 34 by any convenient means such as a multiposition switch or a digital data keyboard. The value of S determines the integration time of the filters, or the response time. A small value of S provides a fast response time at the expense of reduced resolution accuracy while a large value of S provides a slow response time but is accompanied by a higher resolution accuracy. The response time $T_R$ of the octave filters is approximately $T_R = S\ T_s$. If S=10 m, m=64 and $T_s = 1/2093$ then the response time is about 0.30 seconds.

The RESET signal generated by the counter 34 is used to initialize all the accumulators in the individual octave filters to a zero value.

FIG. 3 illustrates the detailed system logic for the maximum octave detect 3. The six adder-accumulators for the six octave filters are symbolically shown in FIG. 3 as the set of adder-accumulators 30,33,71 and 72. The data value in each of the accumulators in the set of six adder-accumulators is connected to the data select 73.

The counter 78 counts the timing signals produced by the clock 23 modulo a number P. P is the total number of octave filters. For the illustrative system, P=6. The binary count states for the counter 78 are decoded onto a set of six signal lines by means of the count state decoder 74. In response to a signal on one of the six lines from the count state decoder 74, the data select 73 transfers the content of an associated accumulator to the comparator 75.

The comparator 75 compares the numerical value of the data transferred by the data select 73 with a data value stored in the data latch 76. If the data value received from the data latch 73 is larger in numerical value than the data value stored in the data latch 76, then the comparator 75 causes the larger of the two data values to be stored in the data latch 76. If the data value stored in the data latch 76 is changed, then the comparator causes the data latch 76 to also store the current count state of the counter 78.

When the RESET signal is generated by the counter 34, the count state of the counter 78 stored in the data latch is transferred to the note filters 14 by means of the gate 77. After this count state has been transferred, the RESET signal is used to initialize the data values stored in the data latch 76 to zero values. The count state transferred by the gate 77 designates the musical octave corresponding to the input signal generated by means of the microphone 10. In the above described fashion new estimates of the octave number are continuously made and provided to the gate 77.

Figure 4:
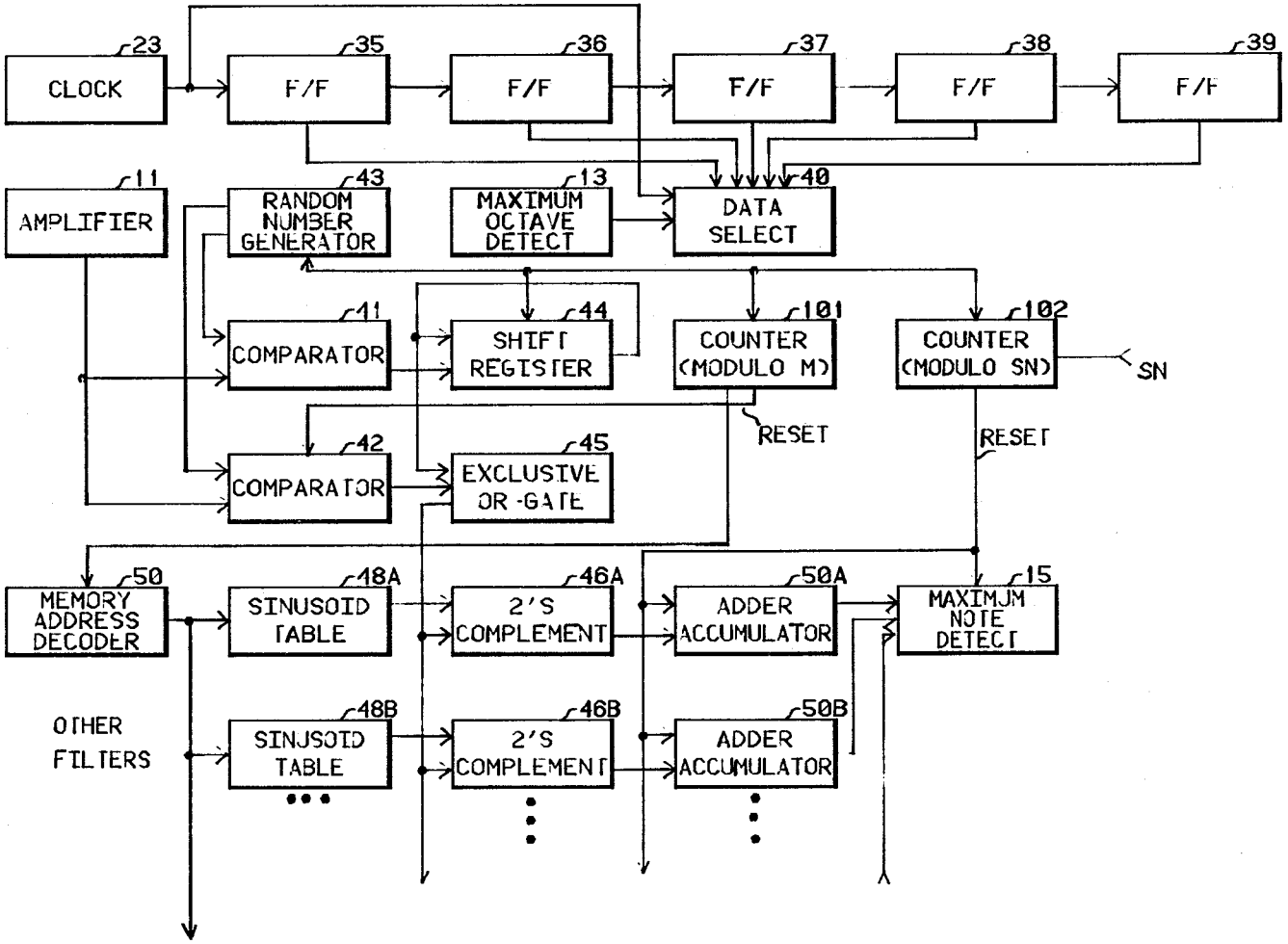
FIG. 4 is a schematic diagram of the note filters 14.
Figure 5:
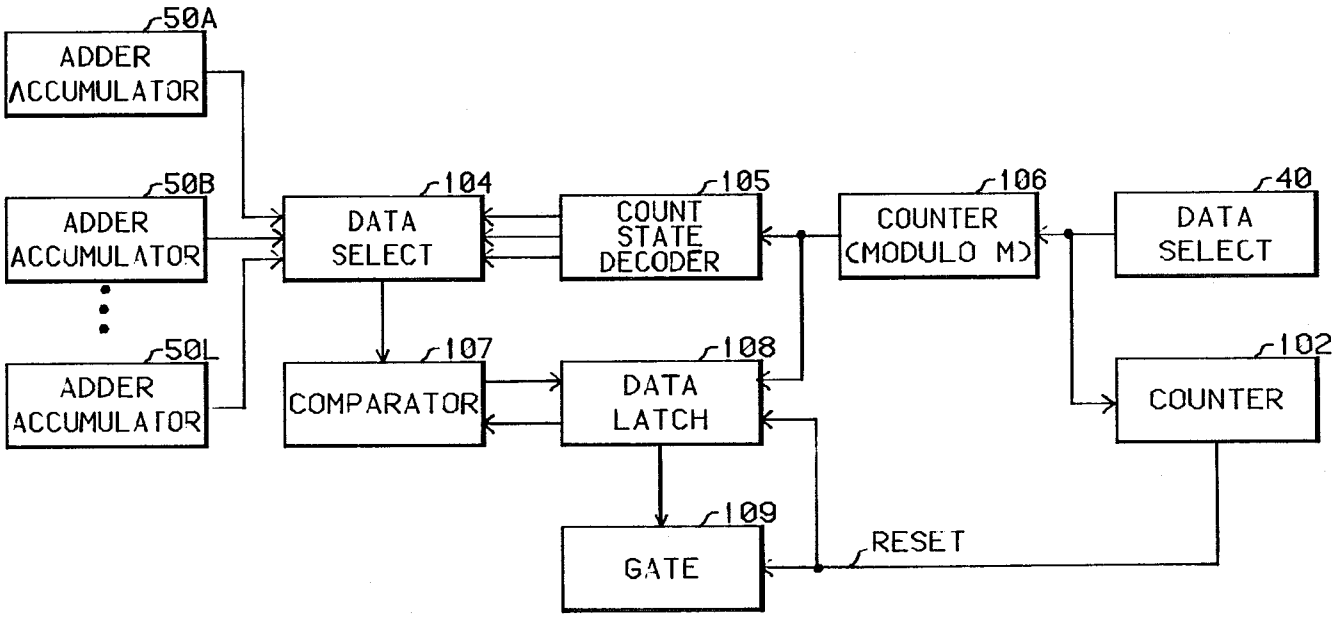

FIG. 4 illustrates the detailed system logic for the note filters 14. A sequence of flip-flops 35–39 are used to form a chain of frequency dividers. These frequency dividers provide a set of timing signals which are octave divisions of the frequency of the timing signals furnished by the clock 23. Each flip-flop provides a sequence of timing signals which has a frequency rate corresponding to the highest note in its associated octave. Flip-flop 35 corresponds to the octave range $C_6$ to $B_6$. Flip-flop 36 corresponds to the octave range $C_5$ to $B_5$. Flip-flop 37 corresponds to the octave $C_4$ to $B_4$. Flip-flop 38 corresponds to the octave $C_3$ to $B_3$. Flip-flop 39 corresponds to the octave $C_2$ to $B_2$.

The data select 40, in response to the octave choice made by the maximum octave select 13 and provided by the gate 77, selects the clock signals produced by the corresponding flip-flop in the set of flip-flops 35–39 or the output from the clock 23 which corresponds to the highest note $C_7$.

The remainder of the system logic shown in FIG. 4 for the note filters 14 operates in a manner shown in FIG. 2 for the octave filters 12 and which has previously been described.

The random number generator 43 generates pairs of random numbers $y_i$ and $y_j$ which are each statistically independent and are uniformly distributed in value and have a maximum amplitude equal to a number B and a minimum amplitude equal to -B. The random number generator 43 can be implemented in the same manner as the implementation for the random number generator 20.

The comparator 41 generates a logic "1" state binary signal if the signal $x_i$ furnished by the amplifier 11 at a time $t_i$, corresponding to a timing signal transferred by the data select 40, is greater than or equal in numeric magnitude to the random number $y_i$ generated by the random number generator 43 at the same time $t_i$. If the data value $x_i$ is less in numeric amplitude than the random number $y_i$, then a logic "0" state binary signal is generated by the comparator 41. The sequence of binary state signals generated by the comparator 41 are stored in the shift register 44. The shift register 44 stores N data points and is operated in a conventional end-around mode in response to the timing signals transferred by the data select 40.

In the same fashion as described for the comparator 41, the comparator 42 generates a logic "1" binary state signal if the signal amplitude $x_j$ for the amplifier 11 is greater than or equal to the second random number $y_j$ created by the random number generator 43. The comparator 42 generates a logic "0" binary state signal if the signal amplitude $x_j$ is less than the random signal $y_j$.

The comparator 42 generates a signum value of $x_j - y_j$ each time that the counter 102 is reset to its initial count state and generates a RESET signal. Counter 102 is incremented by the timing signals selected by the data select 40 and the counter is implemented to count modulo M. For a tuning indicator M=12. This corresponds to the number of musical notes in an equal tempered musical octave.

The data in the shift register 44 is shifted in the end-around shift mode for a complete set of M stored data points for each data value generated by the comparator 41.

The exclusive OR-gate 45 forms the product of the previous M signum values generated by the comparator 41 with the current signum value generated by the comparator 42.

FIG. 4 explicitly shows two sinusoid tables 48A and 48B. These are symbolic of a set of 12 sinusoid tables 48A to 48L wherein there is a sinusoid table dedicated to each one of the 12 notes in an octave of an equal tempered musical octave. Trigonometric function values, having the values described below, are addressed simultaneously from each one of the 12 sinusoid tables 48A–48L by the memory address decoder 50 in response to the count state of the counter 101.

There is a 2's complement means associated with each one of the 12 sinusoid tables. While only a 2's complement 46A and a 2's complement 46B are shown explicitly in FIG. 4, these are symbolic of the arrangement of the complete set of 2's complement 46A to 46L.

Each of the 2's complement means will transfer its input trigonometric function value unaltered if the current output from the exclusive OR-gate 45 has a "1" logic binary signal state. If the OR-gate 45 has a "0" logic binary signal state, each of the 2's complement means will perform a binary 2's complement operation on its input trigonometric function value before transferring an output data value.

There is an adder-accumulator associated with each of the 12 2's complement means. While only adder-accumulator 50A and adder-accumulator 50B are shown explicitly in FIG. 4, these are symbolic of the arrangement of the complete set of 12 adder-accumulators 50A to 50L.

Each adder-accumulator adds the data transferred by its associated 2's complement to the sum contained in an accumulator which is an element of the adder-accumulator.

The data value contained in each of the accumlulators in the set of adder-accumulators 50A to 50L is transferred to the maximum note detect 15. In a manner described below, the maximum note detect 15 determines which one of the set of 12 adder-accumulators 50A–50L contains the maximum value at the time that the counter 102 generates a RESET signal.

The counter 102 counts the timing signals selected by the data select 40 modulo a prespecified modulo number SN. Each time that the counter 102 is incremented so that it returns to its minimal count state, a RESET signal is generated. The modulo number SN is provided to the counter 102 by a convenient means such as a multiposition switch or a digital data generating keyboard terminal. The value of SN determines the integration time, or the response time of the note filters 14.

The RESET signal generated by the counter 102 is used to initialize all the accumulators in the set of adder-accumulators 50A–50L to a zero value.

For the individual note filters in the note filters 15 the value of k in Eq. 8 is replaced by the parameter k' where $$k' = 2^{(k-1)/12} \qquad \text{Eq. 12}$$

The various sinusoid tables in the set of sinusoid tables 48A–48L store the following sets of trigonometric cosine function values.

Sinusoid Table 48A: $\cos(\pi/12), \cos(\pi 2/12), \ldots, \cos(\pi 12/12)$

Sinusoid Table 48B: $\cos(\pi 2p_1/12), \cos(\pi 2p_1/12), \ldots, \cos(\pi 12p_1/12)$ Sinusoid Table 48C: $\cos(\pi 2p_2/12), \cos(\pi 2p_2/12), \ldots, \cos(\pi 12p_2/12)$ In general form, if the sinusoid table 48A to 48L are numbered from j=1 to j=1 12, the sinusoid table j will store the set trigonometric function values $$\cos(\pi p_j/12), \cos(\pi 2p_j/12), \ldots, \cos(\pi 12p_j/12)$$

where $p_j = 2^{j/12}$.

Figure 5:
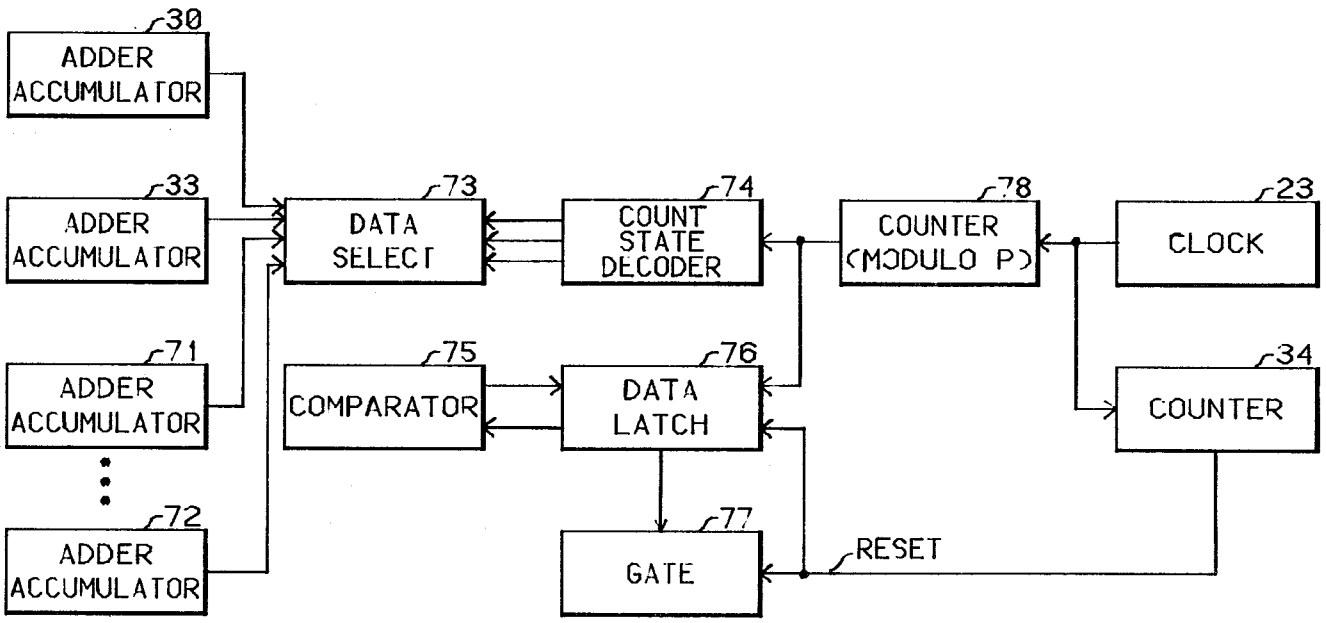
FIG. 5 is a schematic diagram of the maximum note detect 15.

FIG. 5 illustrates the detailed system logic for the maximum note detect 15. This subsystem operates in a manner analogous to that of the maximum octave detect 13 shown in FIG. 3 and previously described.

The set of adder-accumulators 50A–50L are connected to furnish the data in each of their accumulators to the data select 104. The counter 106 counts the timing signals transferred by the data select 40 modulo 12. The binary count states for the counter 104 are decoded onto a set of 12 signal lines by means of the count state decoder 105.

In response to a signal on one of the 12 lines from the count state decoder 105, the data select 104 transfers the data from an associated adder-accumulator to the comparator 107. The comparator 107 compares the numerical value of the data transferred by the data select 104 with a data value stored in the data latch 108. If the data value received from the data latch 108 is larger in numerical value than the data value stored in the data latch 108, then the comparator 107 causes the larger of the two data values to be stored in the data latch 108. If the data value stored in the data latch 108 is changed, then the comparator 107 causes the data latch 108 to also store the current count state of the counter 106.

When the RESET signal is generated by the counter 102, the count state of the counter 106 which is stored in the data latch 108 is transferred to the cent filters 16 by means of the gate 109. After this count state has been transferred, the RESET signal is used to initialize the data values stored in the data latch 108 to zero values. The count state transferred by the gate 109 designates the musical note within a musical octave for the input signal generated by means of the microphone 10. In the described fashion, new estimates of the musical note are made in a continuous sequence of decisions and the results are provided to and transferred by the gate 109.

Musicians measure the deviation of a tone of frequency $f_1$ with respect to a tone of frequency $f_2$ in units of cents C where C is defined by the relation $$C = (1200/\log 2) \log (f_1/f_2) \qquad \text{Eq. 13}$$

There are 1200 cents in a musical octave and there are 100 cents allotted to each note within an octave.

It is not necessary, or desirable, to estimate the deviation of a tone to the full range of plus and minus 50 cents to an accuracy of one cent. The primary object of a tuning indicator is not to measure the frequency of a note played into a microphone. Instead one observes that the musician only wishes to know if the note he plays is close to the true frequency and if it is sharp or flat with respect to the true frequency. As a general rule, if a note is within about three cents of the true frequency, the note is considered to be "in tune."

The preferred embodiment of the present invention provides a tuning indication resolution of one cent for a spread of five cents on either side of the true musical note frequency. All frequency errors greater than five cents are indicated merely as a sharp tone and all frequency errors less than five cents are indicated merely as a flat tone.

Figure 6:
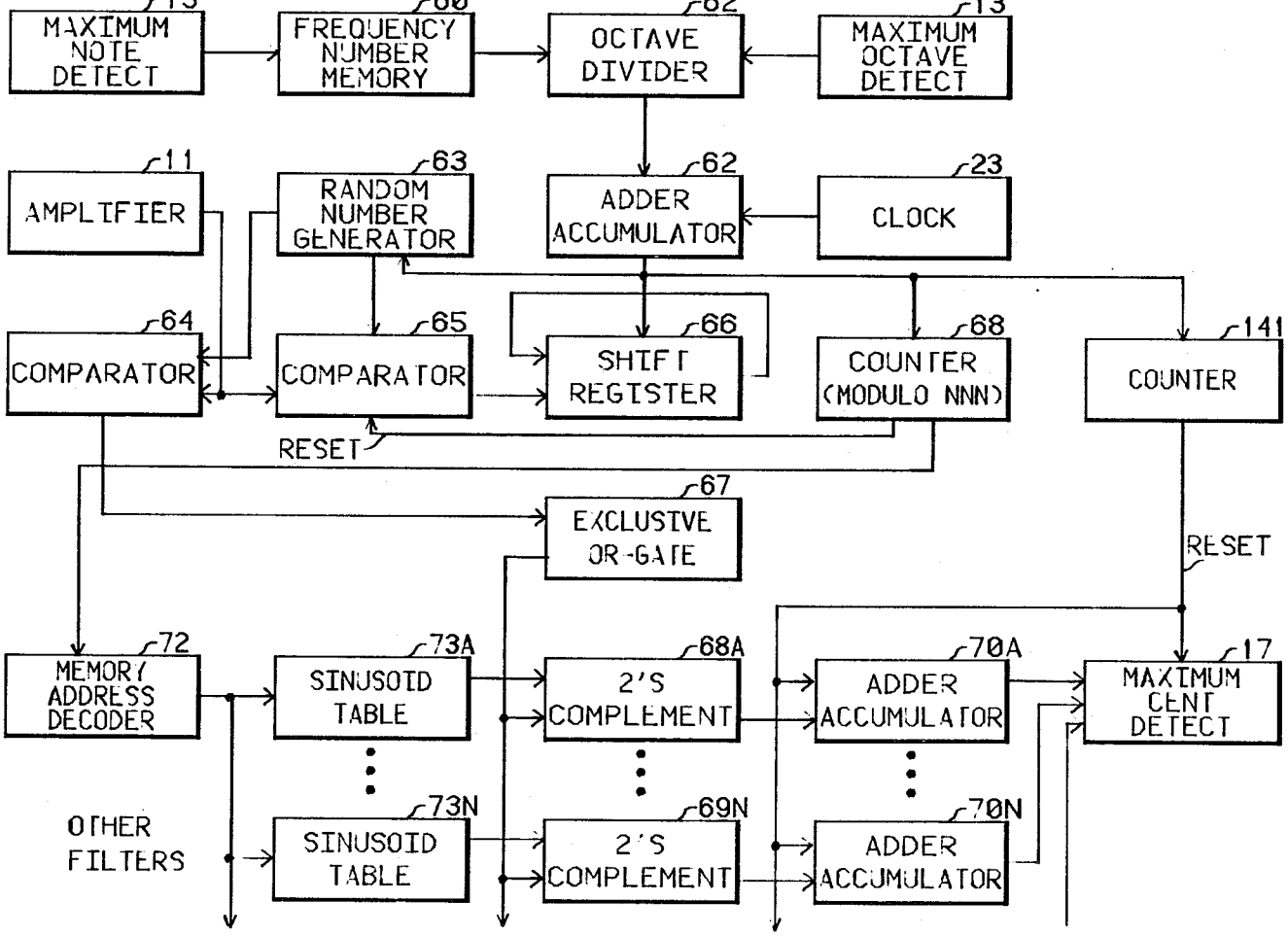
FIG. 6 is a schematic diagram of the cent filters 16.

The system details of the cent filters 16 are shown in FIG. 6.

The frequency number memory 60 stores 12 frequency numbers $R_1, R_2, \ldots, R_{12}$ corresponding to the notes in the highest octave range capability of the tuning indicator. The frequency numbers are computed from the relation $$R_k = 2^{-(k-1)/12};\ k = 1, 2, \ldots, 12 \qquad \text{Eq. 14}$$

The frequency number read out of the frequency number theory 60 in response to the signal transferred to the maximum note detect 15 is a number that corresponds to one note higher in frequency than the note detected by the maximum note detect 15.

The octave divider 62 divides the frequency number read out of the frequency number memory in response to an octave signal generated by the maximum octave detect 13. Because of the frequency relation between musical octaves, the octave divider 62 can be implemented as a binary right shift operation on the binary formatted frequency numbers. The number of right shifts corresponds to the octave number detected by the maximum octave detect 13.

The adder-accumulator 62 adds the divided frequency number produced by the octave divider 62 to an accumulator in response to the timing signals produced by the clock 23.

The content of the accumulator in the adder-accumulator 62 is called an accumulated frequency number. The accumulated frequency number comprises an integer part and a decimal part because the frequency numbers stored in the frequency number memory 60 correspond to decimal values less than or equal to one. Circuitry is incorporated within the adder-accumulator 62 whereby a timing signal is produced each time that the integer portion of the accumulated frequency number increases in value.

The random number generator 63 generates pairs of random numbers $y_i$ and $y_j$ which are each statistically independent and are uniformly distributed in value and have a maximum amplitude equal to a number B and a minimum amplitude equal to $-B$ The random number generator can be implemented in the same manner as the implementation of the random number generator 20.

The comparator 65 generates a logic "1" state binary signal if the signal $x_i$ furnished by the amplifier 11 at time $t_i$ corresponding to a timing signal generated by the adder-accumulator 62 is greater than or equal in numeric magnitude to the random number $y_i$ generated by the random number generator 63 at the same time $t_i$. If $x_i$ is less than $y_i$, a logic "0" state binary signal is generated. The sequence of binary state signals generated by the comparator 65 are stored in the shift register 66. The shift register 66 stores N data points and is operated in a conventional end-around mode in response to the timing signals generated by the adder-accumulator 62.

In the same fashion as described for the comparator 65, the co parator 64 generates a logic "1" binary state signal if the signal amplitude $x_j$ from the amplifier 11 is greater than or equal to the second random number $y_j$ created by the random number generator 63. The comparator 64 generates a logic "0" binary state signal if the $x_j$ is less than $y_j$.

The comparator 64 generates a signum value of $x_j - y_j$ each time that the counter 68 is reset to its initial count state and generates a RESET signal. Counter 68 is incremented by the timing signals generated by the adder-accumulator 62 and counter 68 is incremented to count modulo a modulo number NNN. NNN is chosen to have the value NNN=100. This modulo number corresponds to the number of cents associated with each note within a musical octave.

The data stored in the shift register 66 is shifted in the end-around shift mode for a complete set of 100 stored data points each time that the comparator 64 creates a new data point.

The exclusive OR-gate 67 forms the product of the previous 100 signum values generated by the comparator 65 with the current signum value generated by the comparator 64.

FIG. 6 explicitly shows two sinusoid tables 73A and 73N. These are symbolic of a complete set of 15 sinusoid tables. Trigonometric function values having the values shown below are addressed simultaneously from each of the 15 sinusoid tables by the memory address decoder 72 in response to the count state of the counter 68.

There is a 2's complement 68A–68N means associated with each of the 15 sinusoid tables. Each of the 2's complement means will transfer its input trigonometric function value unaltered if the current output signal from the exclusive OR-gate 67 has a "1" logic binary signal state. If the OR-gate 67 has a "0" logic binary signal state, each of the 2's complement means 70A–70N will perform a binary 2's complement operation on its input trigonometric function value before transferring an output data.

There is an adder-accumulator, in the set of adder-accumulators 70A–70N, associated with each of the 15 2's complement means. Each adder-accumulator adds the data transferred by its associated 2's complement means to the sum contained in an accumulator which is an element of the adder-accumulator.

The data value contained in each of the accumulators in the set of adder-accumulators 70A–70N is transferred to the maximum cent detect 17. In a manner described below, the maximum cent detect 17 determines which one of the set of 15 adder-accumulators 70A–70N contains the maximum value at the time that the counter 141 generates a RESET signal.

The counter 141 counts the timing signals generated by the adder-accumulator 62 modulo a prespecified modulo number SN. Each time that the counter 141 is incremented so that it returns to its minimum count state, a RESET signal is generated.

The RESET signal generated by the counter 141 is used to initialize all the accumulators in the set of adder-accumulators 70A–70N to a zero value.

The first two filters in the set of 15 cent filters are used to detect frequency errors of $-7$ and $-6$ cents. The next six filters are used to detect errors of $-5, -4, \ldots, 0$ cents. The next seven filters are used to detect errors of $1, 2, \ldots, 7$ cents.

Let the frequency $f_1 = f_2 + u$ where u represents the frequency error measured in Hertz. Eq. 13 can be placed in the form $$u = f_2 [\exp (C/Q) - 1] \qquad \text{Eq. 14}$$

where $$Q = 1200/\log 2 \qquad \text{Eq. 15}$$

From these relations, the trigonometric cosine functions stored in the sinusoid tables 73A–73N can be calculated from the relations

| | |
|---|---|
| Table 73A: | $\cos(\pi q k_{-7}/m)$; $q = 1,2, \ldots, m$ |
| Table 73B: | $\cos(\pi q k_{-6}/m)$ |
| Table 73C: | $\cos(\pi q k_{-5}/m)$ |
| Table 73H: | $\cos(\pi q k_{-0}/m)$ |
| Table 73I: | $\cos(\pi q k_{+1}/m)$ |
| Table 73N: | $\cos(\pi q k_{+71}/m)$ |

where $$k_v = 1 + [\exp(v/Q) - 1] \qquad \text{Eq. 16}$$

Figure 7:
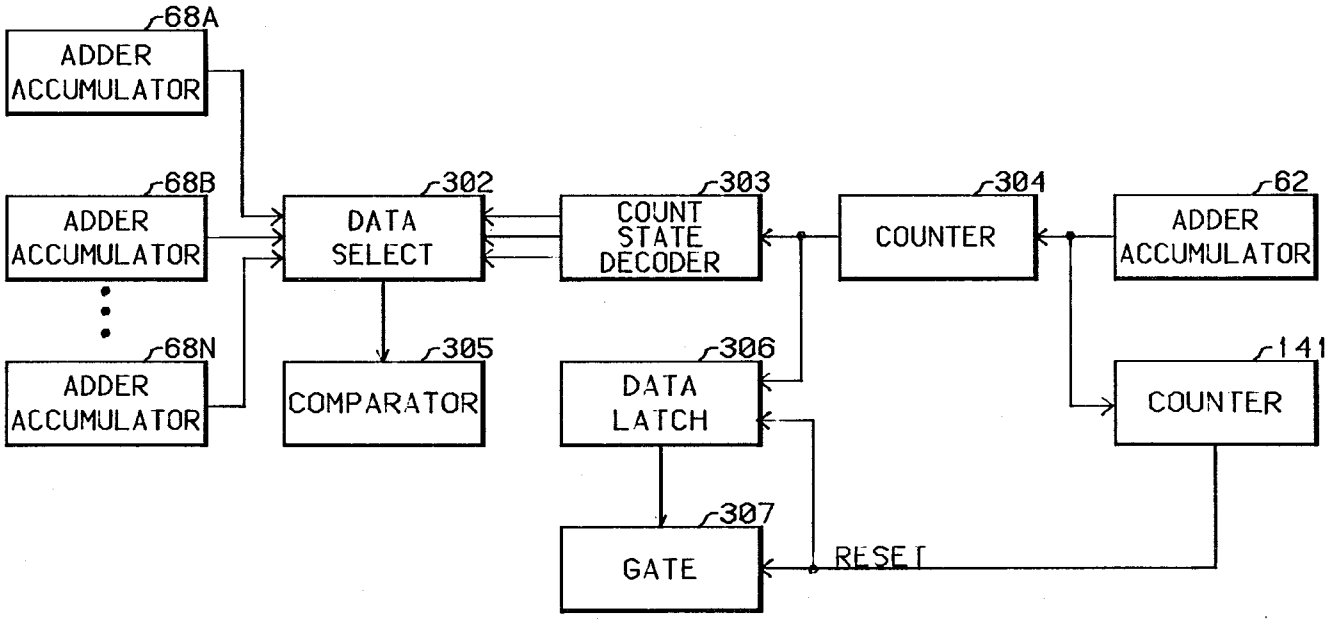
FIG. 7 is a schematic diagram of the maximum cent detect 17.

FIG. 7 illustrates the detailed system logic for the maximum cent detect 17. This subsystem operates in a manner analogous to that of the maximum octave detect 13 shown in FIG. 3 and previously described.

The set of adder-accumulators 68A–68N are connected to furnish the data in each of their accumulators to the data select 302. The counter 304 counts the timing signals generated by the adder-accumulator 62 modulo 15. The binary count states of the counter 304 are decoded onto a set of 15 signal lines by means of the count state decoder 303.

In response to a signal on one of the lines from the count state decoder 303, the data select 302 transfers the data from an associated adder-accumulator to the comparator 305. The comparator 305 compares the numerical value of the data transferred by the data select 302 with a data value stored in the data latch 306. If the data value received fro the data latch 306 is larger in numerical value than the data value stored in the data latch 306, then the comparator 305 causes the larger of the two data values to be stored in the data latch 306. If the data value stored in the data latch 306 is changed, then the comparator 305 causes the data latch 306 to also store the current count state of the counter 106.

When the RESET signal is generated by the counter 141, the count state of the counter 304 which is stored in the data latch 306 is transferred to the display 18 by means of the gate 307. After this count state has been transferred, the RESET signal is used to initialize the data values stored in the data latch 306 to zero values. The count state transferred by the gate 307 designates the tuning error for the input signal generated by means of the microphone 10.

The display 18 displays the octave number and the musical note within the octave in response to the output signal data from the maximum octave detect 13 and the maximum note detect 15. The display 18 indicates the cent number output from the maximum cent detect 17 if the number is less than +6 and greater than −6. If the cent number is −6 or −7, then only a single indication of a flat note is displayed. If the cent number is 6 or 7, then only a single indication of a sharp note is displayed. The display 18 can be implemented in a variety of forms using known methods of displaying digital binary numbers such as LED (light emitting diode) displays.

Figure 8:
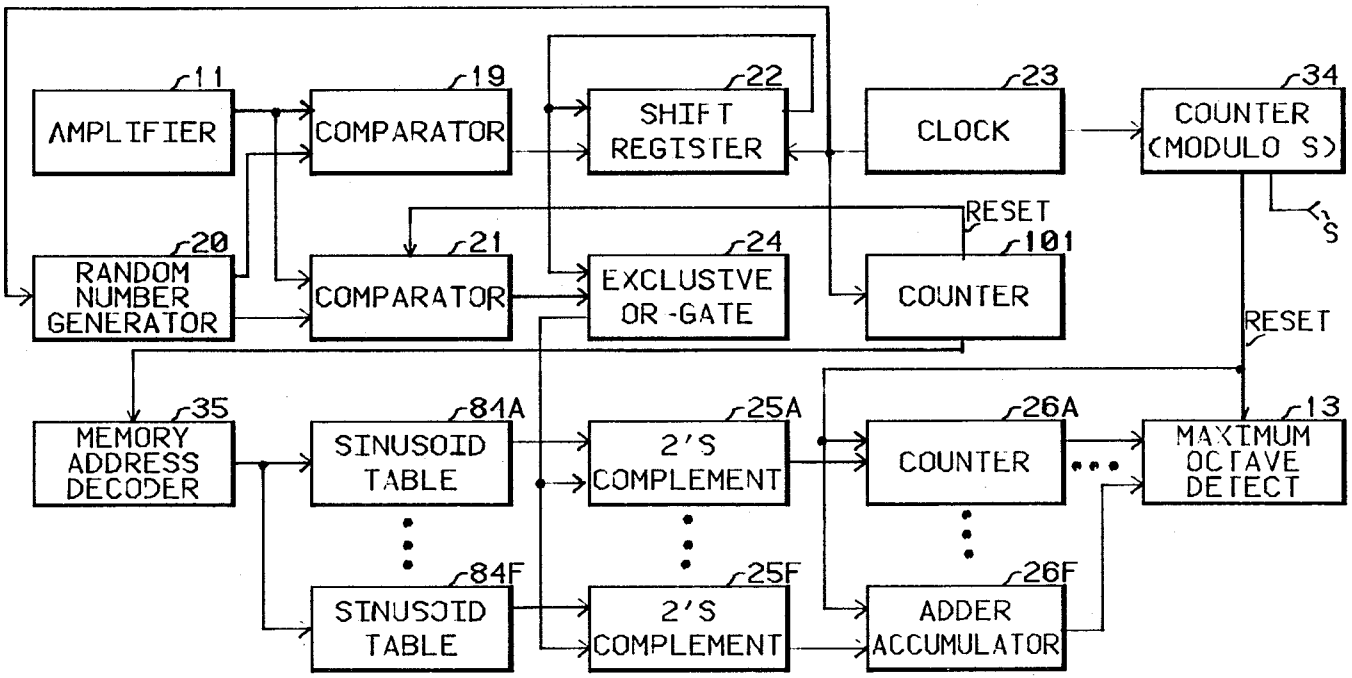
FIG. 8 is an alternate configuration for the octave filters 12.

FIG. 8 illustrates an alternate configuration for the octave filters 12. This configuration and operation is essentially identical to the system shown in FIG. 2 and previously described with the exception of the number of filters and the contents of the various sinusoid tables. In the system shown in FIG. 8 there are six sinusoid tables 84A–845. There a 2's complement means associated with each of the sinusoid tables in the set of 2's complement 25A–25F. There is an adder-accumulator in the set 26A–26F associated with each 2's complement means.

The trigonometric sinusoid tables store the value of the following trigonometric functions.

TABLE 3

| Sinusoid Table | Stored Function Values |
|---|---|
| 84A | $\cos(\pi/64), \cos(\pi 2/64), \cos(\pi 3/64), \ldots, \cos(\pi 6/64)$ |
| 84B | $\cos(\pi/32), \cos(\pi 2/32), \cos(\pi 3/32), \ldots, \cos(\pi 6/32)$ |
| 84C | $\cos(\pi/16), \cos(\pi 2/16), \cos(\pi 3/16), \ldots, \cos(\pi 6/16)$ |
| 84D | $\cos(\pi/8), \cos(\pi 2/8), \cos(\pi 3/8), \ldots, \cos(\pi 6/8)$ |
| 84E | $\cos(\pi/4), \cos(\pi 2/4), \cos(\pi 3/4), \ldots, \cos(\pi 6/4)$ |
| 84F | $\cos(\pi/2), \cos(\pi 2/2), \cos(\pi 3/2), \ldots, \cos(\pi 6/2)$ |

I claim:

1. Apparatus for indicating the tuning error of a tone produced by a musical instrument comprising;

a conversion means for converting said tone into a waveshape signal, an octave detection means whereby an octave signal is generated in response to said waveshape signal, a note detection means whereby a note signal is generated in response to said waveshape signal and in response to said octave signal, a cent detection means whereby a cent signal is generated in response to said waveshape signal and in response to said note signal, and a tuning display means whereby said tuning error is indicated in response to said octave signal, said note signal, and said cent signal.

2. Apparatus according to claim 1 wherein said conversion means comprises;

a microphone transducer means whereby an audible acoustic signal from said musical instrument is converted into said waveshape signal.

3. Apparatus according to claim 1 wherein said octave detection means comprises;

a digital conversion means whereby said waveshape signal is converted into a sequence of binary logic state signals, a plurality of contiguous digital filters which jointly span a prespecified number of musical octaves wherein each one of said plurality of contiguous digital filters generates an octave filter number in response to said sequence of binary logic state signals, and a maximum octave detect means wherein said octave signal is created in response to the maximum value of the octave filter numbers generated by said plurality of contiguous digital filters.

4. Apparatus according to claim 3 wherein said digital conversion means comprises;

a clock means for providing timing signals, a random number generator wherein a first random number and a second random number is generated in response to said timing signals, and a first comparator means responsive to said waveshape signal whereby a "one" binary logic state signal is generated if said first random number is greater or equal in amplitude to said waveshape signal and whereby a "zero" binary logic state signal is generated if said first random number is less in amplitude than said waveshape signal thereby generating said sequence of binary logic state signals.

5. Apparatus according to claim 4 wherein said plurality of digital filters comprises;

a shift register means for storing a subsequence of a prespecified number N of logic states from said sequence ob binary logic state signals, a first counter for counting said timing signals modulo said prespecified number N wherein a reset signal is generated each time said first counter returns to its minimal count state, a second comparator means responsive to said waveshape signal whereby in response to said reset signal a "one" binary logic state signal is generated if said second random number is greater than or equal in magnitude to said waveshape signal and whereby a "zero" binary logic state signal is generated if said second random number is less in magnitude than said waveshape signal, a shift register reading means whereby said binary logic state signals stored in said shift register means are sequentially read out in response to said timing signals, an exclusive OR-gate means responsive to said binary logic state signal generated by said second comparator means whereby a sequence of binary logic state control signals is generated in response to said binary logic state signals read out from said shift register means, a plurality of arithmetic means each of which comprises, a sinusoid table for storing trigonometric function values, a sinusoid table reading means whereby a trigonometric function value is read out from said sinusoid table in response to the count state of said first counter, a 2's complement means responsive to said sequence of binary logic state signals whereby if a binary logic state signal has a "one" logic state the trigonometric function value read out from said sinusoid table is transferred unaltered and whereby if a binary logic state signal has a "zero" logic state the trigonometric function value read out from said sinusoid table is changed to its binary 2's complement form before it is transferred, an adder-accumulator means, comprising an accumulator, whereby the trigonometric values transferred by said 2's complement means are successively added to the content of said accumulator thereby generating said octave filter number, a second counter for counting said timing signals modulo a prespecified number S whereby a reset control signal is generated each time said second counter returns to its minimal count state, and clearing circuitry means whereby in response to said reset control signal each accumulator contained in each said adder-accumulator means in said plurality of arithmetic means is initialized to a zero numeric state.

6. Apparatus according to claim 1 wherein said note detection means comprises;

a digital conversion means responsive to said octave signal whereby said waveshape signal is converted into a sequence of binary logic state signals, a plurality of contiguous note filters each of which spans a musical note in a musical octave and wherein each one of said plurality of contiguous note filters generates a note filter number in response to said sequence of binary logic state signals, and a maximum note detect means wherein said note signal is created in response to the maximum value of the note filter number generated by said plurality of contiguous note filters.

7. Apparatus according to claim 6 wherein said digital conversion means comprises;

a means for producing timing signals at a frequency responsive to said octave signal, a random number generator wherein a first random number and a second random number is generated in response to said timing signals, and a first comparator means responsive to said waveshape signal whereby a "one" binary logic state signal is generated if said first random number is greater or equal in amplitude to said waveshape signal and whereby a "zero" binary logic state signal is generated if said first random number is less in amplitude than said waveshape signal thereby generating said sequence of binary logic state signals.

8. Apparatus according to claim 7 wherein said plurality of contiguous note digital filters comprises;

a shift register means for storing a subsequence of a prespecified number M of logic states from said sequence of binary logic state signals,, a first counter for counting said timing signals modulo said prespecified number M wherein a reset signal is generated each time said first counter returns to its minimal count state, a second comparator means responsive to said waveshape signal whereby in response to said reset signal a "one" binary logic state signal is generated if said second random number is greater than or equal in magnitude to said waveshape signal and whereby a "zero" binary logic state signal is generated if said second random number is less in magnitude than said waveshape signal, a shift register reading means whereby said binary logic state signals stored in said shift register means are sequentially read out in response to said timing signals, an exclusive OR-gate means responsive to said binary logic state signal generated by said second comparator means whereby a sequence of binary logic state control signals is generated in response to said binary logic state signals read out from said shift register means, a plurality of arithmetic means each of which generates a note filter number, and a second counter means for counting said timing signals modulo a prespecified number whereby a reset control signal is generated each time said second counter returns to its minimal count state.

9. Apparatus according to claim 8 wherein each one of said plurality of arithmetic means comprises;

a sinusoid table for storing trigonometric function values, a sinusoid table reading means whereby a trigonometric function value is read out from said sinusoid table in response to the count state of said first counter, a 2's complement means responsive to said sequence of binary logic state signals whereby a trigonometric function value read out of said sinusoid table is transferred unaltered in response to a binary logic state signal which has a "one" state value and whereby a trigonometric function value is converted to its binary 2's complement form in response to a binary logic state signal which has a "zero" state value before it is transferred, an adder-accumulator means, comprising an accumulator, whereby the trigonometric function values transferred by said 2's complement means are successively added to the content of said accumulator thereby generating said note filter number, and clearing circuitry whereby the content of the accumulator in said adder-accumulator means is initialized to a zero numeric state in response to said reset control signal.

10. Apparatus according to claim 1 wherein said cent detection means comprises;

a digital conversion means responsive to said note signal whereby said waveshape signal is converted into a sequence of binary logic state signals, a plurality of contiguous cent filters each of which spans a frequency range of one cent and wherein each one of said plurality of contiguous cent filters generates a cent number in response to said sequence of binary logic state signals, and a maximum cent detect means wherein said cent signal is created in response to the maximum value of the cent filter numbers generated by said plurality of contiguous cent filters.

11. Apparatus according to claim 10 wherein said digital conversion means comprises;

a means for producing timing signals at a frequency responsive to said note signal, a random number generator wherein a first random and a second random number is generated in response to said timing signals, and a first comparator means responsive to said waveshape signal whereby a "one" binary logic state signal is generated if said first random number is greater or equal in amplitude to said waveshape signal and whereby a "zero" binary logic state is generated if said first random number is less in amplitude than said waveshape signal thereby generating said sequence of binary logic state signals.

12. Apparatus according to claim 11 wherein said plurality of contiguous cent filters comprises;

a shift register means for storing a subsequence of a prespecified number of logic states from said sequence of binary logic state signals, a first counter for counting said timing signals modulo said prespecified number wherein a reset signal is generated each time said first counter returns to its minimal count state, a second comparator means responsive to said waveshape signal whereby in response to said reset signal a "one" binary logic state signal is generated if said second random number is greater than or equal in magnitude to said waveshape signal and whereby a "zero" binary logic state signal is generated if said second random number is less in magnitude than said waveshape signal, a shift register reading means whereby said binary logic state signals stored in said shift register means are sequentially read out in response to said timing signals, an exclusive OR-gate means responsive to said binary logic state signal generated by said second comparator means whereby a sequence of binary logic state control signals is generated in response to said binary logic state signals read out from said shift register means, a plurality of arithmetic means each of which generates a cent filter number, and a second counter means for counting said timing signals modulo a prespecified number whereby a reset control signal is generated each time said second counter returns to its minimal count state.

13. Apparatus according to claim 12 wherein each one of said plurality of arithmetic means comprises;

a sinusoid table for storing trigonometric function values, a sinusoid table reading means whereby a trigonometric function value is read out from said sinusoid table in response to the count state of said first counter, a 2's complement means responsive to said sequence of binary logic state signals whereby a trigonometric function value read out of said sinusoid table is transferred unaltered in response to a binary logic state signal which has a "one" state value and whereby a trigonometric function value is converted to its binary 2's complement form in response to a binary logic state signal which as a "zero" state value before it is transferred, an adder-accumulator means, comprising an accumulator, whereby the trigonometric function values transferred by said 2's complement means are successively added to the content of said accumulator thereby generating said cent filter number, and clearing circuitry whereby the content of the accumulator in said adder-accumulator means is initialized to a zero numeric state in response to said reset control signal.

* * * * *